United States Patent [19]

Money

[11] Patent Number: 4,508,464

[45] Date of Patent: Apr. 2, 1985

[54] FOLDABLE PEN

[76] Inventor: Michael F. Money, 85 Homestead Ave., Bridgeport, Conn. 06605

[21] Appl. No.: 450,911

[22] Filed: Mar. 14, 1983

[51] Int. Cl.[3] ..... B43K 19/00; B43K 7/00

[52] U.S. Cl. ..... 401/6; 40/334; 401/209

[58] Field of Search ..... 401/6, 195; 40/334, 40/335

[56] References Cited

U.S. PATENT DOCUMENTS

| | | | |
|---|---|---|---|
| 3,168,072 | 2/1965 | Nitta | 401/6 X |
| 4,200,403 | 4/1980 | Chu | 401/6 |
| 4,243,338 | 1/1981 | Williams | 40/334 X |

FOREIGN-PATENT DOCUMENTS

| | | | |
|---|---|---|---|
| 2431377 | 3/1980 | France | 401/195 |

*Primary Examiner*—Steven A. Bratlie

[57] ABSTRACT

A pen adapted to be flat, when not being used for writing, can be used as a bookmark, when unfolded into such a flat shape. The pen has three flat panels with one of the panels being connected to each of the other panels at opposite longitudinal edges by hinges, so that all three panels lie in the same plane when the pen is unfolded. One of the panels has a hollow reservoir for storing and dispensing ink. A pen tip for dispensing the ink extends into the hollow reservoir.

8 Claims, 3 Drawing Figures

FOLDABLE PEN

BACKGROUND OF THE INVENTION

The present invention relates to a pen which lies flat, when it is not being used for writing, and can be used as a bookmark when unfolded. When the pen is to be used for writing, it folds into a triangular prism, so that it can be easily grasped by the hand.

Pens of the state of the art have a barrel which have generally either a circular, hexagonal, or triangular cross-sectional shape. While pens with barrels of these shapes are easy to hold when they are being used for writing, these barrels also have certain disadvantages, due to their thickness and shape.

When a person, such as a student, is using a pen to make notes of the contents of a book, it is not uncommon for the person to use the pen as a bookmark. But due to the thickness of the barrel, damage to the book can occur, if the book is closed while the pen is between the pages.

Furthermore, while it is possible to put writing, such as advertising, on the exterior of the barrels of pens of the state of the art, their shapes do not make it easy to do so. In addition due to their shapes not too much writing can be printed on the barrel nor is it easy to read it.

SUMMARY OF THE INVENTION

The disadvantages set forth above are eliminated by the present invention which is a pen that lies flat, when it is not being used for writing. When the pen is to be used for writing, it folds into a shape which can be easily grasped by a hand. Furthermore, as the pen lies flat, it is easier to put writing on its exterior and the writing can be arranged so that it is easier to read.

The invention comprises a pen, preferably made by injection molding, whose barrel is made of three flat panels. One of the panels is connected by a first hinge on one side to the second panel and the third panel is connected by a second hinge to the opposite side of the first panel, so that a single plane is formed by the three panels. Thus, since the pen lies flat it can be placed, between the pages of a book as a bookmark, without damaging the book.

One of the panels has a hollow reservoir for storing and dispensing ink, with a pen tip, such as a ballpoint tip or felt tip, extending into the reservoir, through which the ink will be dispensed. To use the pen as a writing instrument, the outer edges of the two outer panels are pressed between the fingers of the hand until the outer edges of the two outer panels meet. Due to the hinges connecting the panels, a triangular prism results, which is easy for the hand to grasp while writing with the pen. The flat panels forming the barrel can be made of any suitable plastic or paper material such as polyethylene.

BRIEF DESCRIPTION OF THE DRAWINGS

Further features and advantages of the invention become clear from the following description and drawings.

PREFERRED EMBODIMENT

Figure 1:
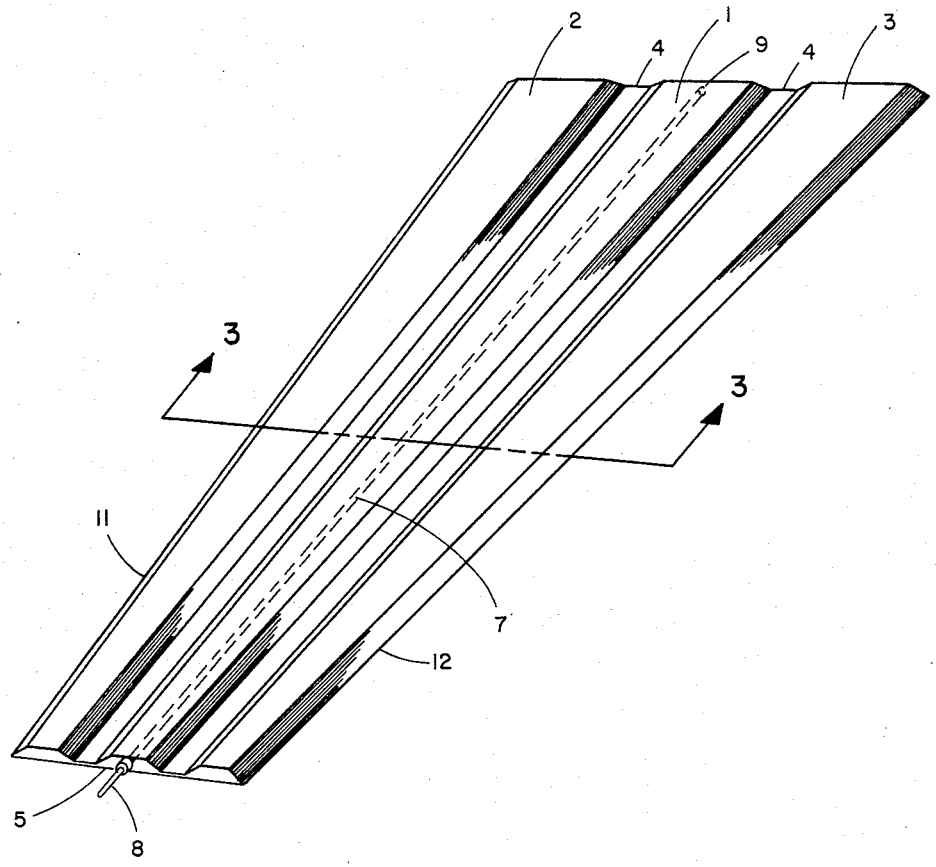
FIG. 1 is a perspective view showing the pen, when it is flat.
Figure 3:
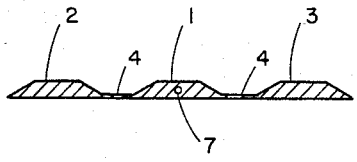
FIG. 3 is a section along plane 3—3 in FIG. 1.

As shown in FIG. 1, the pen is comprised of three panels, 1, 2 and 3, with the first panel 1 being attached to the second panel 2 and the third panel 3 at opposite edges by means of conventional plastic hinges 4, so that all three panels are in the same plane. Each of the panels 1, 2 and 3 are the same size and tapered at one end 5. Also, each edge of each panel is beveled.

The first panel 1 has a hollow reservoir 7 for storing and dispensing ink. A pen tip 8, such as a ballpoint tip or felt tip, through which the ink will be dispensed extends into the hollow reservoir at the tapered end of the first panel 1. At the end of the first panel 1 opposite of the location of the pen tip 8 a venting orifice 9 opens into the reservoir 7.

Figure 2:
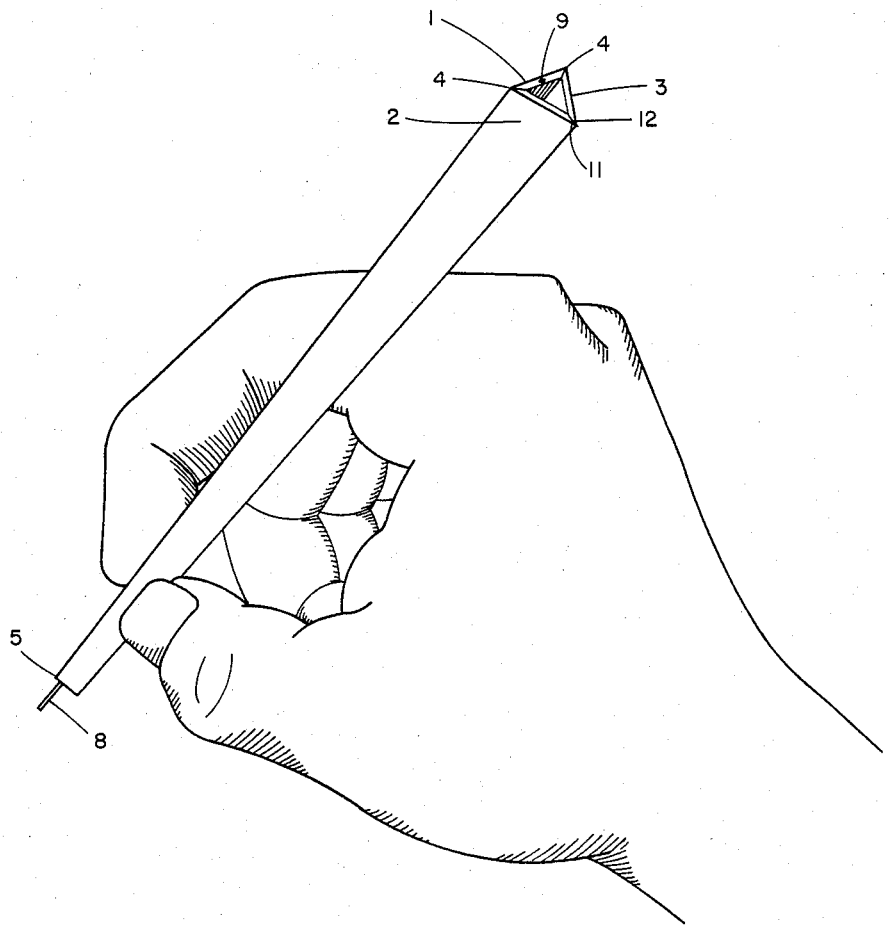
FIG. 2 is a perspective view showing the pen, being grasped by a hand, ready to be used for writing.

As shown in FIG. 2, when the pen is to be used for writing, the outer edges 11 and 12 of respectively the second and third panel 2 and 3 are pressed between the fingers of the hand until they touch. As each edge of each panel 1, 2 and 3 are beveled, the edges matingly meet. A triangular prism results, which is easy for the hand to grasp when the pen is being used for writing.

When the person is finished using the pen for writing, the pressure by the fingers is released and due to the plastic hinges 4 the pen resumes the flat shape shown in FIG. 1.

Although the invention is illustrated and described with reference to one preferred embodiment thereof, it is to be expressly understood that it is in no way limited to the disclosure of such a preferred embodiment, but is capable of numerous modifications within the scope of the appended claims.

I claim:

1. A foldable pen comprising, (a) a substantially flat material of substantially quadrilateral shape, molded such that there are formed two longitudinal depressions in said material, said depressions defining three panels and said depressions acting as hinges between said panels, such that the pen may assume two distinct shapes, either a virtually flat substantially quadrilateral object, or, when folded at its hinges, a prism;

(b) a hollow reservoir for storing and dispensing ink located in one of the panels, and (c) a pen tip extending into the reservoir for dispensing the ink.

2. A foldable pen as claimed in claim 1, wherein each of the panels is the same size.

3. A foldable pen as claimed in claim 1, wherein each of the edges of each panel is beveled.

4. A foldable pen as claimed in claim 2 or claim 3, wherein each panel is tapered and the folded construction forms a truncated pyramid.

5. A foldable pen as claimed in claim 1, wherein the panel having the hollow reservoir has a venting orifice opening into the hollow reservoir.

6. A foldable pen as claimed in claim 1, wherein the pen tip is a ballpoint tip.

7. A foldable pen as claimed in claim 1, wherein the pen tip is a felt tip.

8. A foldable pen as in claim 1, wherein said flat material with said depressions is formed by injection molding.

* * * * *